United States Patent [19]

Scott

[11] 4,273,464

[45] Jun. 16, 1981

[54] WIRE LINE ANCHOR

[75] Inventor: Anthony C. Scott, Norfolk Great Yarmouth, England

[73] Assignee: Eastman Whipstock, Inc., Houston, Tex.

[21] Appl. No.: 36,305

[22] Filed: May 8, 1979

[51] Int. Cl.[3] ..... B25G 3/00; E21B 23/00

[52] U.S. Cl. ..... 403/348; 166/240; 294/86.1

[58] Field of Search ..... 403/348, 349; 166/240, 166/241; 294/86.1

[56] References Cited

U.S. PATENT DOCUMENTS

| | | | |
|---|---|---|---|
| 252,657 | 1/1882 | Githens | 403/348 X |
| 3,036,641 | 5/1962 | Nutter et al. | 166/240 X |
| 3,248,129 | 4/1966 | Brown | 403/349 X |
| 4,135,577 | 1/1979 | Nelson | 166/240 X |

*Primary Examiner*—James Kee Chi

*Attorney, Agent, or Firm*—Jennings B. Thompson; Marvin B. Eickenroht

[57] ABSTRACT

A wire line anchor has a slot in its side wall that will move the slot into position to engage a key attached to a housing in a pipe string to hold the anchor against upward movement relative to the housing. The anchor is released from the key by subsequent downward movement followed by upward movement of the anchor relative to the key.

2 Claims, 2 Drawing Figures

WIRE LINE ANCHOR

This invention relates to a wire line anchor for connecting and disconnecting a wire line to a down hole housing located in a pipe string in a well bore by manipulation of the wire line.

It is common practice today during certain drilling operations for an instrument package to be lowered through the drill pipe on a flexible wire line to a seat provided therefore in the drill pipe to monitor selected conditions in the well bore and to transmit this information to the surface. The "wire line" used to lower and retrieve such instrument packages is actually an electric cable that is designed not only to support the weight of the instrument package, but also to conduct electrical signals between the instrument package and the surface. Therefore, when the term "wire line" is used throughout this specification it is intended to include electric cables as well as non-electrical cables.

Where these instrument packages are used to determine the inclination and azimuthal direction of a well bore as it is being drilled, it is important that the instrument package be positioned in a predetermined orientation relative to the drilling assembly.

Otherwise, information transmitted to the surface would be erroneous. Usually, the instrument package is oriented properly as it moves into the seat or housing located downhole in the drill pipe by engaging guide surfaces and key members on the instrument package and downhole housing. Therefore, it is important to know that the instrument package is properly seated in the housing provided to receive it. This problem was addressed in U.S. Pat. No. 4,121,657, which issued on Oct. 24, 1978, entitled "Position Indicator for Down Hole Tool". This patent describes apparatus for indicating at the surface when the instrument package is properly seated.

With the apparatus disclosed in the aforementioned U.S. patent, slack is maintained in the wire line to insure that the instrument package remains fully seated in its housing as drilling progresses. If too much slack is provided, the wire may be wadded up or kinked by the downwardly moving mud stream which may damage the wire line or the electrical conductors of the electric cable. If too little slack is provided as the drilling progresses, the wire line can pull the instrument package from its seat.

This problem can be solved by maintaining uniform tension in the wire line instead of providing it with slack. Cable drums are available that will maintain a constant tension in a cable or wire line. This would require however, that the wire line be anchored to something down hole so that this tension can be maintained in the line.

It is an object of this invention to provide apparatus for anchoring a wire line in a housing located down hole in a pipe string to allow the wire line to be maintained in tension. Another advantage of being able to anchor a wire line in a housing down hole is that it indicates at the surface that the instrument package is properly seated and will remain so long as the proper tension is maintained on the cable.

It is another feature and object of this invention to provide a wire line anchor that can be connected to a housing located down hole in a pipe string and released from the housing upon vertical manipulation of the wire line. This is an important and essential feature of this invention. The wire line may extend through thousands of feet of drill pipe and even though it may be possible to anchor the wire line to allow the tension described above to be maintained, unless the anchor can be released to allow the wire line and instrument package to be removed from the drill pipe the problem would not be solved.

These and other objects, advantages, and features of this invention will be apparent to those skilled in the art in consideration of this specification including the attached drawings and appended claims.

Figure 1:
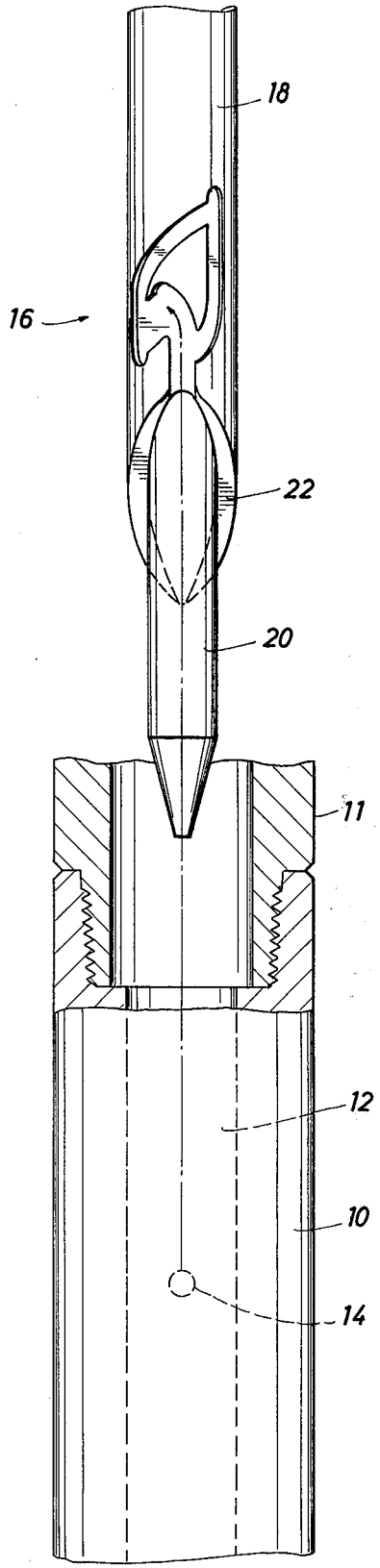
FIG. 1 is a side view in elevation of the wire line anchor of this invention positioned to move into the anchor housing located down hole in a pipe string.

Housing 10 is a tubular member adapted to be connected into pipe string 11 in the well known manner. Housing 10 has central opening 12. Key 14 is attached to housing 10 and extends into opening 12. The key is cylindrical and is positioned with its longitudinal axis extending perpendicular to the longitudinal axis of opening 12.

Anchor 16 comprises generally cylindrical member 18 and guide 20 which is located in the central opening of cylindrical member 18. Guide 20 protrudes below member 18 to guide the anchor as it travels downwardly through pipe string 11 into housing 10. In the side wall of cylindrical member 18, slot system S is provided for moving anchor 16 relative to key 14 to position the key in the slot system to hold the anchor from upward movement relative to the anchor housing. This is accomplished by the downward movement of the anchor relative to the housing a distance limited by the key and the slot system and the subsequent upward movement of the anchor by the wire line a distance limited by the key and the slot system.

Figure 2:
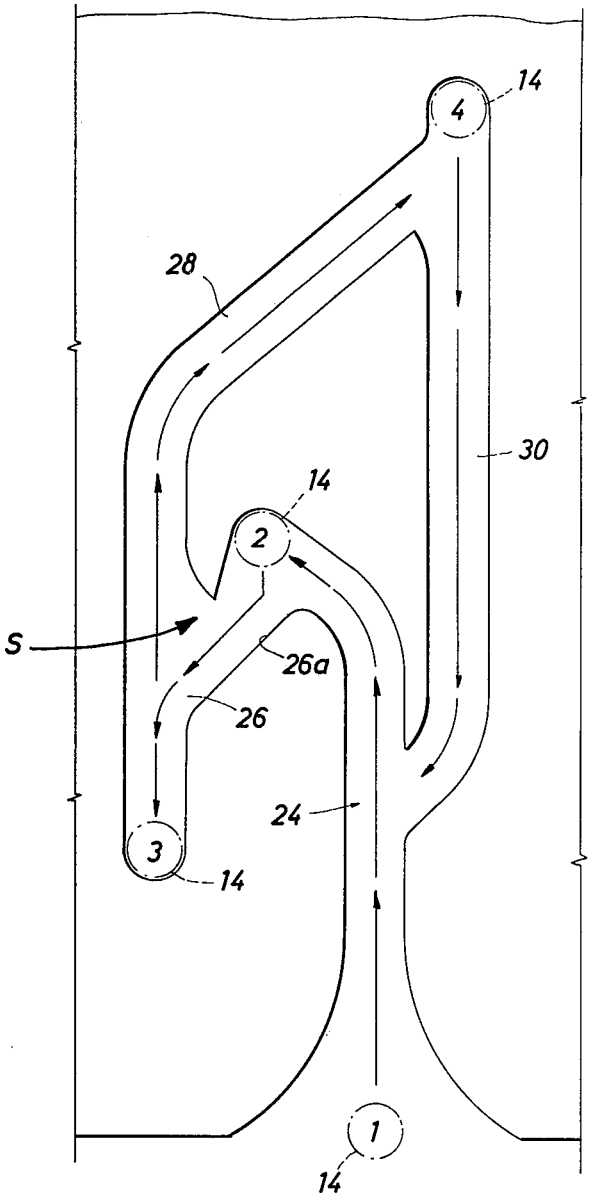
FIG. 2 is a plan view of the slot provided on the side of the anchor to receive the key located in the housing that will hold the anchor against upward movement to allow the wire line to be placed in tension and will allow the anchor to be released for removal from the pipe string upon vertical manipulation of the wire line.

As will be understood from FIG. 1, anchor 16 is lowered into anchor housing 10 until key 14 prevents further downward movement. The lower end of cylindrical member 18 of the anchor is machined to provide upwardly inclined surface 22 that will orient anchor 16 in a preselected position so that key 14 will enter the slot system as the anchor is lowered into the opening in the housing. This is commonly called a mule shoe. The locking movement described above is best seen in FIG. 2 where the path of the key relative to the slot system in the anchor can be readily seen. Various positions of the key in the slot system are indicated by the numbers 1–4.

When the key is in position 1, anchor 16 is being moved downwardly through the housing and mule shoe 22 has oriented the anchor so that the key 14 is in the position indicated by the number 1. Continued downward movement of the anchor will cause key 14 to move upwardly relative to the slot system through the entrance section of the slot system, which will guide the anchor to a position with the key at the upper end of the entrance section of the slot. This section is indicated by the number 24. When key 14 is located at the upper end of entrance section 24, it will stop any further downward movement of anchor 16. Subsequent upward movement of the anchor by the wire line will cause key 14 to move relative to the slot system to the position indicated by the member 3 at the bottom of anchor section 26 of the slot system. It is understood that the key is not actually moving but the anchor is, therefore, as the anchor moves downwardly over the key to move the key into the upper end of the entrance section, the anchor will actually be rotated around its longitudinal axis as the key moves to position 2. This places the key over downwardly inclined surface 26*a*. Upward movement of the anchor will now move key 14 into engagement with downward inclined surface 26*a* of the slot system causing the anchor to again rotate around its longitudinal axis as the key moves toward position 3. Continued upward movement of the anchor will now move key 14 to the bottom of the anchor section 26 of the slot system, which is position 3.

In this position, tension can be placed in the wire line or cable attached to the anchor to the extent desired. The anchor will be held in engagement with key 14 which will keep the instrument package (not shown) of which the anchor is a part properly oriented with respect to the drilling assembly (not shown) since the position of the key relative to the drilling assembly is known.

When it is desired to release the anchor from the anchor housing, downward movement of the wire line will move the anchor downwardly relative to key 14 causing the key to travel through first release section 28 of the slot system to position 4. Here further downward movement of the anchor is prevented again by key 14 resting against the upper end of both the first release section 28 and the second release section 30. With the key so positioned, upward movement of the anchor by the wire line will cause key 14 to enter section release section 30 and as the anchor continues upwardly to return to entrance section 24 and out of engagement with the slot system through the entrance section. The anchor and the instrument package are now free to be pulled out of the drill pipe.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described what is claimed is:

1. Apparatus for attaching an anchor connected to a wire line to an anchor housing located in a pipe string in a well bore and for releasing the anchor from the anchor housing by raising and lowering the anchor with the wire line relative to the housing, comprising an anchor housing for connecting in a pipe string located in a well bore, an anchor for attaching to a wire line for movement into and out of the pipe string, said anchor housing having an opening to receive the anchor and a key attached to the housing and extending into the opening to engage the anchor, said anchor having a section with a cylindrical outer surface in which a slot system is formed to receive the key and to move the anchor relative to the key to position the key in the slot system to hold the anchor from upward movement relative to the anchor housing upon the downward movement of the anchor relative to the key a distance limited by the key and the slot system and the subsequent upward movement of the anchor by the wire line a distance limited by the key and the slot system to allow an upward force to be applied to the wire line and for releasing the anchor from the housing by lowering the anchor until further downward movement is prevented by the key and the slot system and moving the anchor upwardly to move the key out of engagement with the slot system.

2. A releasable wire line anchor for attaching a wire line to an anchor housing located in a pipe string in a well bore, said anchor housing having an opening to receive the anchor and a key protruding into the opening, said anchor comprising a cylindrical member for attaching to a wire line to be lowered into a pipe string in a well bore, said member having a diameter such that the member cannot pass downwardly through the anchor housing without engaging the key, a key slot system formed in the outside surface of the anchor member to receive the key and means to guide the member into position for the key to move into the slot system as the member is lowered into the anchor housing, said slot system having an entrance section to receive the key and to guide the member to a position with the key at the upper end of the entrance section where the key stops further downward movement of the member, said entrance section of the slot system having its upper portion inclined to rotate the member as it moves downwardly to position the key at the upper end of the entrance section and have a downwardly extending anchor section of the slot system to receive the key as the member is moved upwardly by the wire line until the key reaches the bottom of the anchor section and stops further upward movement of the member relative to the key and the housing to allow the desired tension to be placed in the wire line, said slot system further including a first release section which extends upwardly from the bottom of the anchor section to guide the member as it is moved downwardly to the wire line to move the key past the upper end of the entrance section to the upper end of the first release section of the slot system where downward movement of the member is stopped by the key, and a second release section extending downwardly from the upper end of the first release section to guide the key to the entrance section as the member is moved upwardly to allow the member to be moved out of engagement with the key for removal from the well bore.

* * * * *